US005840408A

United States Patent [19]

Giansetto

[11] Patent Number: 5,840,408

[45] Date of Patent: Nov. 24, 1998

[54] DECORATIVE APPLIQUES FOR GARMENTS

[76] Inventor: Elene M. Giansetto, 29 Washington Pl., Ridgewood, N.J. 07450

[21] Appl. No.: 663,945

[22] Filed: Jun. 14, 1996

[51] Int. Cl.[6] ..... A41D 19/00

[52] U.S. Cl. ..... 428/190; 428/196; 428/343; 2/244

[58] Field of Search ..... 428/101, 190, 428/196, 343; 2/244

[56] References Cited

U.S. PATENT DOCUMENTS 4,776,043 10/1988 Coleman ..... 2/244

4,975,986 12/1990 Strongwater ..... 2/244

*Primary Examiner*—Marion E. McCamish
*Assistant Examiner*—Elizabeth M. Cole
*Attorney, Agent, or Firm*—Ezra Sutton

[57] ABSTRACT

A decorative applique for removably adhering to the interior surface of a sheer garment to create a silhouette on the exterior surface of the sheer garment. The decorative applique includes an applique structure having an adhering surface; and glue on the adhering surface for removably adhering the decorative applique to the interior surface of the sheer garment by pressing the adhering surface against the interior surface of the sheer garment to create a silhouette on the exterior surface of the sheer garment.

12 Claims, 5 Drawing Sheets

DECORATIVE APPLIQUES FOR GARMENTS

FIELD OF THE INVENTION

This invention relates to decorative appliques for girls' and women's garments, and more particularly, to decorative appliques that removably adhere to the interior surface of a sheer garment to create a silhouette on the exterior surface of that sheer garment.

BACKGROUND OF THE INVENTION

The use of ornaments, emblems, decorations, or appliques in conjunction with various types of clothing, garments, and wearing apparel have taken many forms in relation to appearance, functionality, shape, and materials of construction. The use of various types of appliques being applied to the outside of a garment enables the wearers to promote and display theme material of their own choosing. This provides the wearer the ability to change the applique material, design, style or message to the garment of their choice.

In general, men, women, and children still desire to place decorative ornaments, colored emblems and/or designer appliques on all types of garments they wear including formal attire, casual attire, and intimate attire which makes them personal to the user and/or to make a vanity statement by the wearer.

In the past, this type of personalization to garments has taken the form of hand-made embroidery, common fabric printing or computerized stitching of a word or theme to the outside surface of that particular garment. These methods of personalizing an article of clothing are a permanent fixture to that piece of clothing. Some appliques are applied by glue or cementing to the outside surface of that clothing article having the same results of a permanent fixture to that piece of clothing. Removal of the aforementioned permanent ornaments, emblems, or appliques would ruin that garment, if removal was endeavored by the wearer.

There remains a need for a decorative applique for ornamenting a sheer garment, such as a women's sheer stretch-type top. The applique would have an adhesively-applied, removable design patch, e.g. a ballerina, a flower, a butterfly, a geometric design or the like, which on a sheer garment is placed on the inside of the garment and it shows through as a silhouette. In addition, the applique patch can be removed and re-applied to various areas of the garment, as desired, or completely replaced with another design applique patch.

DESCRIPTION OF THE PRIOR ART

Decorative appliques for garments having various designs, functions, and materials of construction have been disclosed in the prior art. For example, U.S. Pat. No. 1,221,440 discloses the use of embroidered letter or monogram characters to be attached by means of glue or cement to the outside of a garment. U.S. Pat. No. 4,975,987 discloses a clothing ornamentation system and attachment mechanisms for removably attaching an ornament to the outside of a garment by means of a flexible strip having a loop.

The prior art patents disclose and teach the idea of attaching an ornament or applique to the outside of a garment. None of the prior art patents disclose or teach removably applying the applique to the inside surface of a sheer garment so as to be visible through the garment as a silhouette and also the applique is reusable many times.

Accordingly, it is an object of the present invention to provide a decorative applique for sheer garments which can be removably adhered to the interior surface of the woman's or girl's sheer garment to create a silhouette on the exterior surface of that sheer garment.

Another object of the present invention is to provide a decorative applique for sheer garments that is easy to use and can be applied to various types of female sheer garments.

Another object of the present invention is to provide a decorative applique for sheer garments including woman's sheer (see through) blouses, tops, dresses, slips, negligees, pajamas, night gowns, leotards, camisoles, bustiers, chemises, stockings, bathing suits, pantyhose, panties, bras, and the like.

Another object of the present invention is to provide a decorative applique for sheer garments in which the applique is an adhesively-applied and removable design patch which may be able to be re-used several times.

Another object of the present invention is to provide a decorative applique for sheer garments in which the applique has designs featuring a geometric design such as a star, a diamond, etc.; a butterfly; a flower; a tree; a bird; a ballerina; a dancer; an animal; a letter of the alphabet, and the like.

Another object of the present invention is to provide a decorative applique that is made from light-weight materials such as wool, felt, linen, silk, cotton, nylon, rayon, polyester, and the like.

A further object of the present invention is to provide decorative appliques that can be mass produced in an automated and economical manner and are readily affordable by the user.

SUMMARY OF THE INVENTION

The present invention provides a decorative applique for removably adhering to the interior surface of a sheer garment to create a silhouette on the exterior surface of the sheer garment. The decorative applique includes an adhering surface; and tacky glue on the adhering surface for removably adhering the decorative applique to the interior surface of the sheer garment by pressing the adhering surface against the interior surface of the sheer garment to create a silhouette on the exterior surface of the sheer garment.

The decorative applique is made from fabric materials including wool, felt, linen, silk, cotton, nylon, rayon, polyesters, lace and the like. The decorative applique can have design features or structures that include geometric shapes, animals, insects, fauna, human-type activities, indicia and the like.

BRIEF DESCRIPTION OF THE DRAWINGS

Further objects, features, and advantages of the present invention will become apparent upon consideration of the detailed description of the presently-preferred embodiments, when taken in conjunction with the accompanying drawings wherein.

DETAILED DESCRIPTION OF THE PREFERRED EMBODIMENT

Figure 1:
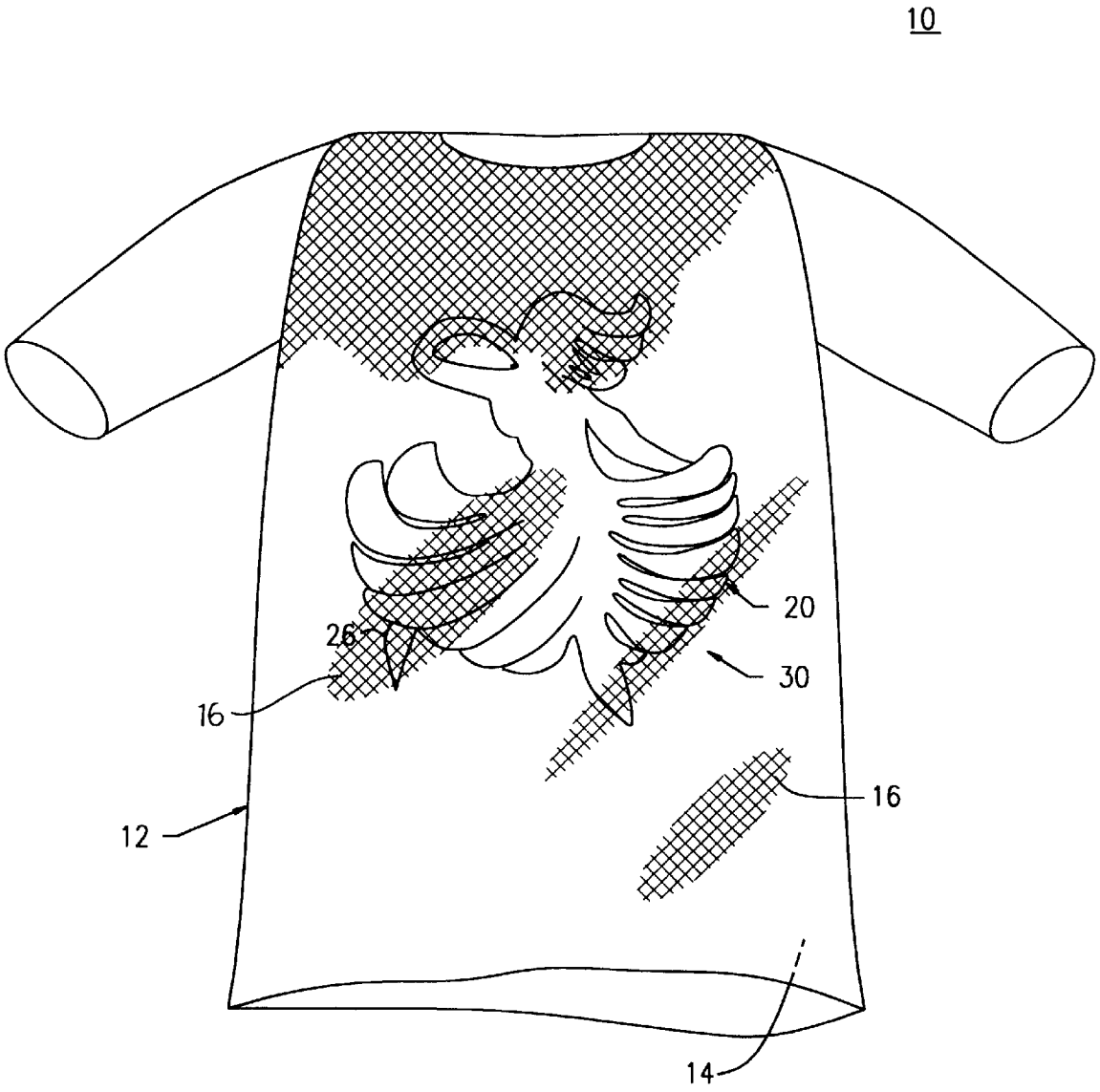
FIG. 1 is a front view of the decorative applique of the preferred embodiment of the present invention showing its attachment to a sheer garment which creates a silhouette on the exterior surface of that sheer garment.
Figure 2:
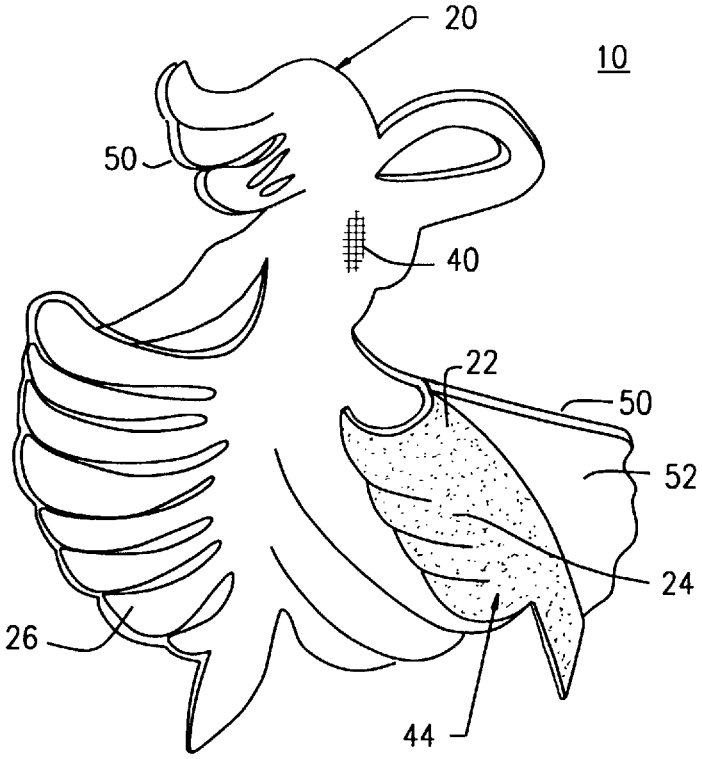
FIG. 2 is a rear view of the decorative applique of the preferred embodiment of the present invention illustrating it in detail.
Figure 3:
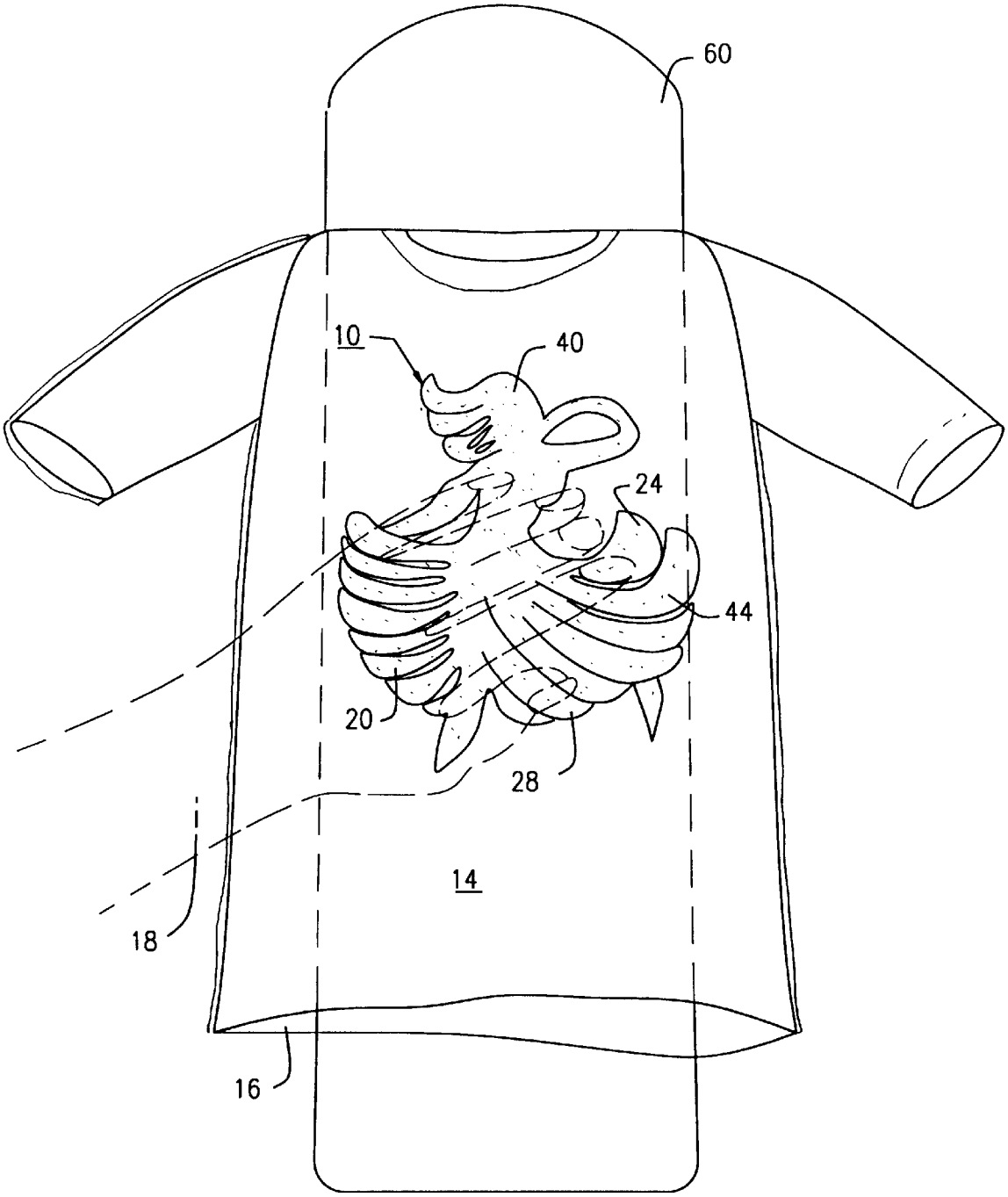
FIG. 3 is a front perspective view of the decorative applique of the preferred embodiment of the present invention showing the applique being applied to the inside surface of a sheer garment.

The preferred embodiment of the present invention provides a decorative applique 10 for sheer garments 12, as represented in FIGS. 1 to 3. The decorative applique 10 of the present invention is used for decorating a women's or girl's sheer garment 12, as shown in FIG. 1. Decorative applique 10 includes an applique structure 20 having an inner surface 22 coated with a pressure sensitive liquid adhesive 24 thereon, and an outer surface 26. The applique 10 is applied to the fabric's inner surface area 14 of the garment 12 which then creates a silhouette 30 on the exterior surface 16 of that sheer garment 12.

The pressure sensitive liquid adhesive 24 is used to form an adhering surface 44 for the temporary bonding of the applique 10 to a sheer garment 12. The applique 10 can be re-used many times as the adhesive 24 does not stick or stay on garment 12. The adhesive 24 does not cause any harm or damage to the fabric surface 14 of garment 12 when the applique 10 is removed from that fabric surface 14. The applique 10 itself can be re-used numerous times, without any damage to the applique structure 20 or garment 12, and without adhesive 24 losing its tackiness for re-sticking many times to the fabric surface 14 of garment 12.

The decorative applique 10 can be applied to women's and girl's sheer garments that include blouses, dresses, tops, leotards, slips, negligees, pajamas, night gowns, camisoles, bustiers, chemises, pantyhose, panties, bras, bathing suits, stockings, and the like.

The applique structure 20 can be made from light-weight fabric materials that include silk, nylon, rayon, polyester, cotton, felt, wool, linen, lace, and the like.

The decorative applique 10 can have design features or structures 20 that include geometric shapes, animals, insects, fauna, human-type activities, indicia, and the like. Examples of such features for geometric shapes include stars, circles, diamonds, squares, rectangles, ovals, triangles, trapezoids, parallelograms, mosaics, and the like. Animal shapes include birds, cats, dogs, lions, tigers, bears, seals, and the like. Insect shapes include spiders, butterflies, bees, lady bugs, grasshoppers, and the like. Fauna shapes include flowers, trees, bushes, fruits, vegetables, and the like. Human-type activities include a representation of a skater, a skier, a dancer, a ballerina, a swimmer, a golfer, and the like. Indicia representations include letters of the alphabet, monograms, words, phrases, and the like.

METHOD OF MANUFACTURING

Figure 4:
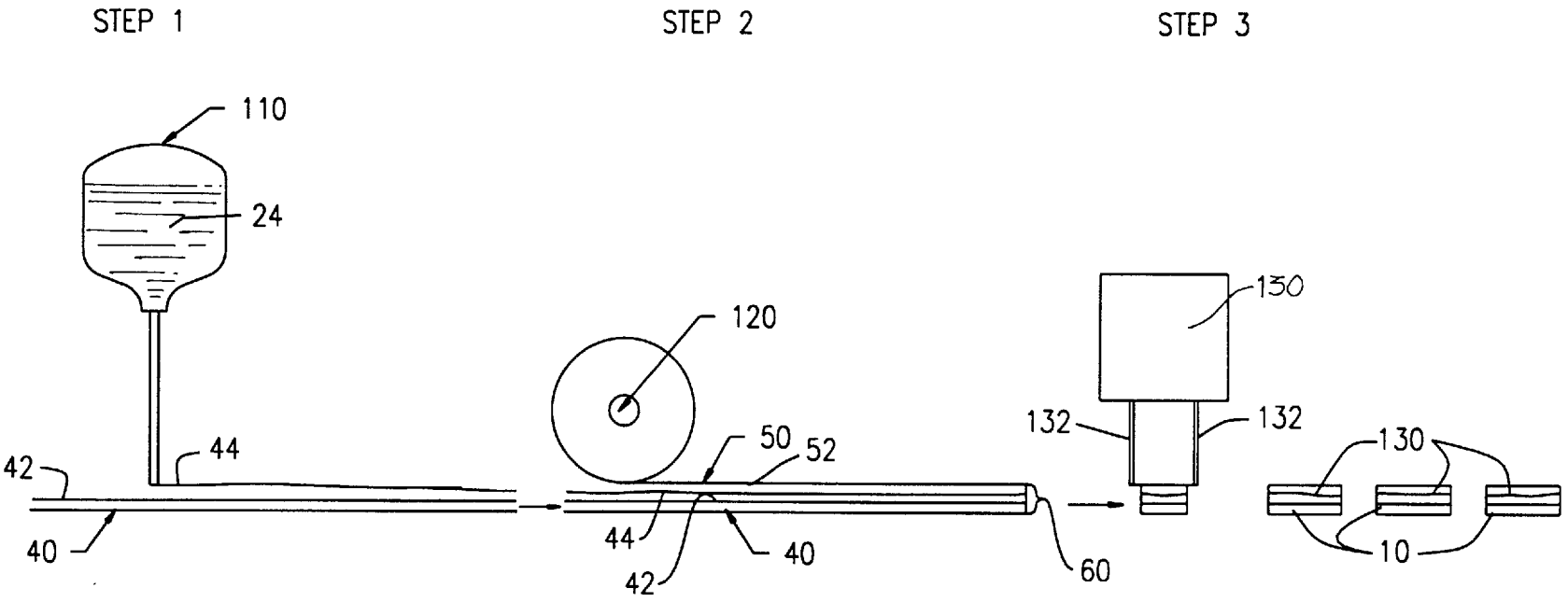
FIG. 4 is a schematic representation of the preferred embodiment of the present invention showing a method of manufacturing the decorative applique for garments.

Production and manufacturing of decorative applique 10, as shown in FIG. 4, consists of a method 100 of three steps. The first step is the application of the pressure sensitive liquid adhesive 24 to a particular fabric material 40, e.g. silk, by an automated glue apparatus 110. The adhesive 24 is applied in a thin adhesive layer 44 to the top surface 42 of fabric material 40 and the adhesive 24 within adhesive layer 44 cures for at least 24 hours to get to a tacky state. The adhesive 24 used for this thin adhesive layer 44 for temporary bonding is a product like Tack It Over and Over™ made by the Aleenes Company. This type of adhesive 24 after curing for 24 hours does not stick to a garment 12 after removing the applique 10 from that garment 12, and the applique 10 can be re-used over and over again without damage to the applique 10 or its adhesive surface layer 44 or to the garment 12. Alternatively, a two-sided pliable and clear adhesive film (not shown) having the same tacky properties, as in the above adhesive layer 44, is applied to at least one side of the adhesive film. This two-sided adhesive film is bonded to the top surface 42 of fabric 40 to form a laminate of an adhesive layer 44 and fabric 40.

The second step includes the layering of a thin film 50 of removable plastic or paper by a roller apparatus 120, such that the bottom inner surface 52 of film 50 laminates with the tacky adhesive surface 44 of fabric 40 to form a laminate composite 60.

The final step is to cut applique 10 to a desired shape 20, e.g. a ballerina figure, by a computerized cutting machine 130 having cutting knives 132 which are used to cut the laminate composite 60. The applique 10 is now ready for use.

Alternatively, the applique 10 may be pre-cut into desired shapes 20 and may be pre-glued with the tacky reusable adhesive 24, having the removable paper cover 50 applied thereto.

OPERATION OF THE PRESENT INVENTION

In using the decorative applique 10 of the present invention, the wearer first selects a given design shape or structure 20 e.g. a ballerina figure, from a selection of various design shapes 20'. The wearer then peels away the thin plastic protective film 50 exposing the tacky adhering surface 44 on the inner surface 22 of applique structure 20. The wearer then turns the sheer garment 12, e.g. a sheer blouse, inside out to expose the interior surface 14, as shown in FIG. 3 of the drawings. The sheer garment 12 is then placed on a suitable flat surface such as an ironing board, table, desk, or the like for applying the decorative applique 10 to the interior surface 14 of sheer garment 12.

The wearer then presses by hand or a flat object (a cold hand iron or rolling pin) the adhering surface 44 against the interior surface 14 of the blouse garment 12 which removably adheres the ballerina shape 20 of decorative applique 10 to the interior fabric 14 of blouse garment 12. The blouse garment 12 is then turned inside-out again, such that the adhering decorative applique 10 creates a silhouette FIG. 30 of the ballerina FIG. 20 visible through the exterior surface 16 of the blouse garment 12, as shown in FIG. 1 of the drawings.

The wearer can remove the ballerina FIG. 20 of decorative applique 10 when needed from the interior fabric surface 14 of the sheer blouse garment 12 for use on another sheer blouse garment 12' or for dry cleaning or washing of the originally used sheer blouse garment 12. The decorative applique 10 can be re-used many times without any degradation occurring to either the adhering surface 44 or fabric material 40 used, in which the applique 10 adheres to the interior surface 14 of a sheer garment 12.

KIT FOR APPLYING DECORATIVE APPLIQUE TO GARMENTS 200

Figure 5:
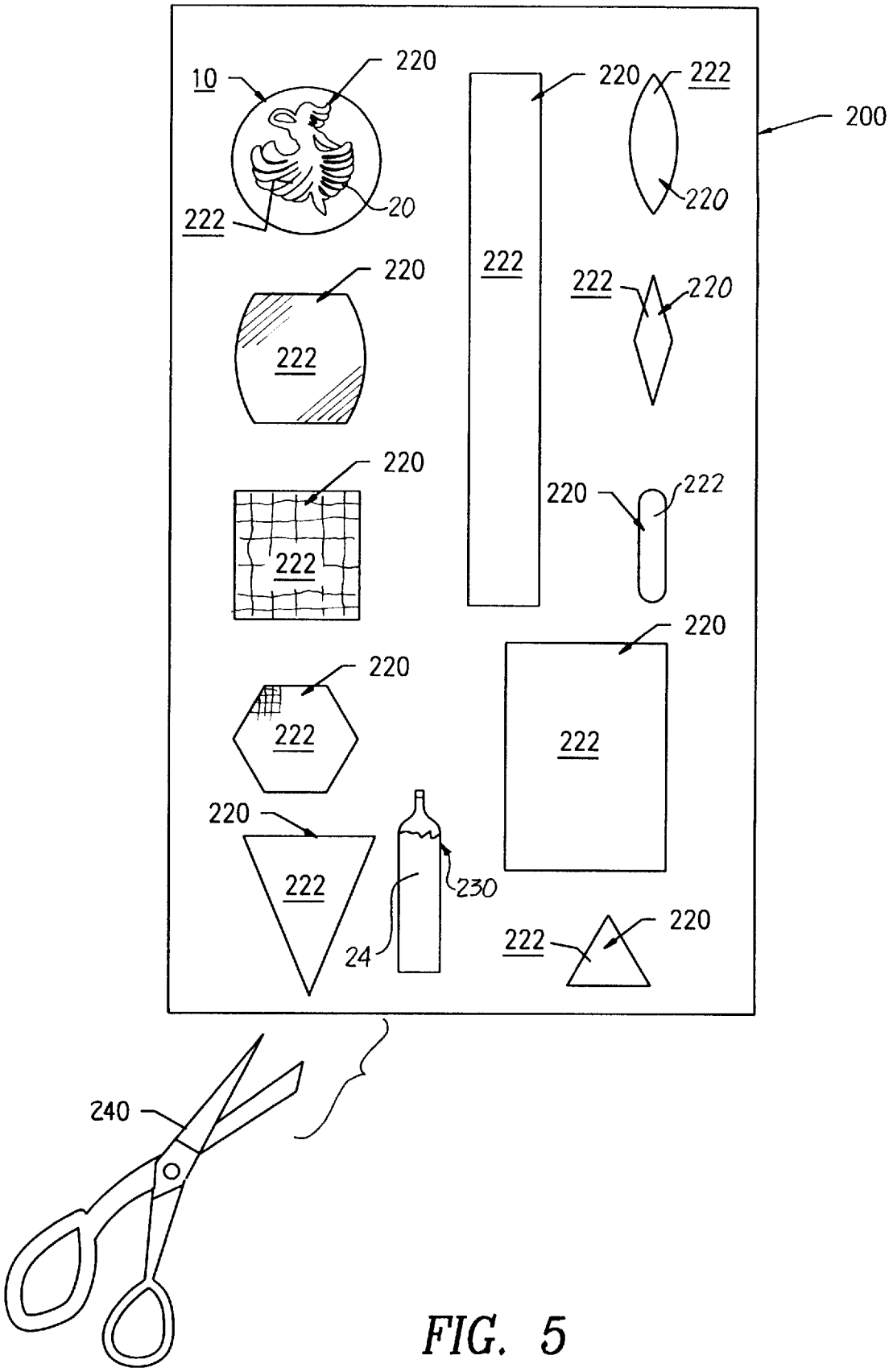
FIG. 5 is an illustration of a kit of the present invention for applying of decorative appliques to sheer garments.

The present invention also provides for a kit 200, as shown in FIG. 5, containing a plurality of applique patches 220 made of different fabric materials having various colors, designs and shapes, and a glue container 230 of adhesive 24 which is used for removably adhering of adhesive 24 to the inner adhering surfaces 222 of applique patches 220 to create adhesive surface layers 44. In using kit 200, the user first selects a particular applique patch 220 of a given fabric material, color and shape. The user then cuts a particular shape or design by using a pair of fabric scissors 240 to create different patterns, e.g. a butterfly, a ballerina, a mosaic design or any form from the applique patch 220. The user, for example, cuts a ballerina shape structure 20 from the circular silk fabric material of applique patch 220, as shown in FIG. 5, to form the decorative applique 10. The user then applies adhesive 24 from glue container 230 in a thin coating to the inner adhering surface 222 of the butterfly design 20 of applique 10. The adhesive 24 cures for at least 24 hours to yield an adhering surface 44 that has a tacky condition for the temporary bonding of applique 10 to a sheer garment 12. The user then presses by hand the adhering surface 44 against the interior fabric surface 14 of a sheer garment 12 to removably adhere the butterfly structure 20 of the decorative applique 10 to the interior fabric surface 14 of a sheer garment 12 to create a silhouette FIG. 30 on the exterior surface 16 of that sheer garment 12. The user can peel away and remove the decorative applique 10 when needed from the interior fabric surface 14 of the sheer garment 12 for reuse on another sheer garment 12' or for the dry cleaning or washing of the sheer garment 12.

ADVANTAGES OF THE PRESENT INVENTION

Accordingly, an advantage of the present invention is that it provides for a decorative applique for sheer garments which can be removably adhered to the interior surface of the woman's or girl's sheer garment to create a silhouette on the exterior surface of that sheer garment.

Another advantage of the present invention is that it provides for a decorative applique for sheer garments that is easy to use and can be applied to various types of female sheer garments.

Another advantage of the present invention is that it provides for a decorative applique for sheer garments including woman's sheer (see through) blouses, tops, dresses, slips, negligees, pajamas, night gowns, leotards, camisoles, bustiers, chemises, stockings, bathing suits, pantyhose, panties, bras, and the like.

Another advantage of the present invention is that it provides for a decorative applique for sheer garments in which the applique is an adhesively-applied and removable design patch which may be able to be re-used several times.

Another advantage of the present invention is that it provides for a decorative applique for sheer garments in which the applique has designs featuring a geometric design such as a star, a diamond, etc.; a butterfly; a flower; a tree; a bird; a ballerina; a dancer; an animal; a letter of the alphabet, and the like.

Another advantage of the present invention is that it provides for a decorative applique that is made from lightweight materials such as wool, felt, linen, silk, cotton, nylon, rayon, polyester, and the like.

A further advantage of the present invention is that it provides for a decorative appliques that can be mass produced in an automated and economical manner and are readily affordable by the user.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A sheer garment having a decorative applique removably adhered to an interior surface of the sheer garment to create a silhouette on the exterior surface of the sheer garment, comprising:

a) a decorative applique having an adhering surface;

b) a sheer garment having an interior surface; and c) glue on said adhering surface for removably adhering said adhering surface and said decorative applique to engage the interior surface of said sheer garment by pressing said adhering surface and said decorative applique against the interior surface of said sheer garment to create a silhouette of said decorative applique on the exterior surface of said sheer garment.

2. A sheer garment having a decorative applique in accordance with claim 1, wherein said decorative applique is made from fabric materials including wool, felt, linen, silk, cotton, nylon, rayon, polyester and lace.

3. A sheer garment having a decorative applique in accordance with claim 1, wherein said decorative applique includes geometric shapes such as stars, circles, diamonds, squares, rectangles, ovals, triangles, trapezoids, parallelograms and mosaics.

4. A sheer garment having a decorative applique in accordance with claim 1, wherein said decorative applique includes animal shapes such as birds, cats, dogs, lions, tigers, bears and seals.

5. A sheer garment having a decorative applique in accordance with claim 1, wherein said decorative applique includes inset shapes such as spiders, butterflies, bees, lady bugs and grasshoppers.

6. A sheer garment having a decorative applique in accordance with claim 1, wherein said decorative applique includes fauna shapes such as flowers, trees, bushes, fruits and vegetables.

7. A sheer garment having a decorative applique in accordance with claim 1, wherein said decorative applique includes human shapes such as a skater, a skier, a dancer, a ballerina, a swimmer and a golfer.

8. A sheer garment having a decorative applique in accordance with claim 1, wherein said decorative applique includes letters of the alphabet, monograms, words and phrases.

9. A sheer garment having a decorative applique in accordance with claim 1, wherein said glue is a pressure-sensitive, adhesive used for the temporary bonding of said decorative applique to said sheer garment.

10. A sheer garment having a decorative applique in accordance with claim 1, wherein said pressure sensitive adhesive remains in a tacky state for numerous re-uses of said decorative applique to said sheer garment or a different sheer garment.

11. A sheer garment having a decorative applique in accordance with claim 1, wherein said glue is a one-sided adhesive film which is used for the temporary bonding of said decorative applique to said a sheer garment.

12. A method of making a sheer garment having a decorative applique applied to an interior surface of said sheer garment to create a silhouette on an exterior surface of the sheer garment, comprising the step of:

a) applying glue to an adhering surface of a decorative applique;

b) pressing said adhering surface and said decorative applique against the interior surface of the sheer garment to removably adhere said decorative applique to the interior surface of the sheer garment to create a silhouette of said decorative applique on the exterior surface of the sheer garment; and c) removing said decorative applique from the interior surface of the sheer garment for reuse of said decorative applique or for cleaning the sheer garment.

* * * * *